US008709205B2

(12) United States Patent
Ozawa et al.

(10) Patent No.: US 8,709,205 B2
(45) Date of Patent: Apr. 29, 2014

(54) POLYIMIDE SHORT FIBERS AND HEAT-RESISTANT PAPER COMPRISING SAME

(75) Inventors: Hideki Ozawa, Ichihara (JP); Fumio Aoki, Ichihara (JP)

(73) Assignee: UBE Industries, Ltd. (JP)

( * ) Notice: Subject to any disclaimer, the term of this patent is extended or adjusted under 35 U.S.C. 154(b) by 0 days.

(21) Appl. No.: 13/514,016

(22) PCT Filed: Dec. 16, 2010

(86) PCT No.: PCT/JP2010/072678

§ 371 (c)(1),
(2), (4) Date: Jun. 18, 2012

(87) PCT Pub. No.: WO2011/074641

PCT Pub. Date: Jun. 23, 2011

(65) Prior Publication Data

US 2012/0241115 A1 Sep. 27, 2012

(30) Foreign Application Priority Data

Dec. 16, 2009 (JP) ..... 2009-285241

(51) Int. Cl.

| | |
|---|---|
| ***D21H 13/00*** | (2006.01) |
| ***C08G 73/10*** | (2006.01) |
| ***C08J 9/00*** | (2006.01) |

(52) U.S. Cl.

USPC ..... 162/157.2; 162/146; 162/157.1; 521/50; 521/90; 521/185; 528/310

(58) Field of Classification Search

USPC ..... 162/1, 13, 28, 141, 146, 157.1–157.3, 162/183, 185; 528/310, 322; 521/50, 90, 521/182–185

See application file for complete search history.

(56) References Cited

U.S. PATENT DOCUMENTS 4,183,783 A * 1/1980 Sunden et al. ..... 162/166

(Continued)

FOREIGN PATENT DOCUMENTS

| | | |
|---|---|---|
| JP | 64-026718 | 1/1989 |
| JP | 06-057529 | 3/1994 |

(Continued)

OTHER PUBLICATIONS

Machine translation of JP 2003-342892, Advanced Industrial Property Network, Japan Patent Office, [online], [retrieved on Sep. 7, 2013]. Retrieved from the Internet: <URL: http://dossier1.ipdl.inpit.go.jp/AIPN/odse_top_dn.ipdl?N0000=7400 >.*

*Primary Examiner* — Dennis Cordray
(74) *Attorney, Agent, or Firm* — Clark Hill PLC

(57) ABSTRACT

Disclosed are polyimide short fibers having an extremely high heat resistance, suitable for non-woven fabrics and paper, and having many branches. Specifically, disclosed are polyimide short fibers having many branches, which are produced by beating and loosening a specific foamed polyimide material. The foamed material preferably comprises a polyimide produced using 2,3,3',4'-biphenyltetracarboxylic acid as an aromatic tetracarboxylic acid component, preferably has a glass transition temperature of 300° C. or higher, and preferably has an expansion ratio of 20 times or more.

18 Claims, 1 Drawing Sheet

(56) References Cited

U.S. PATENT DOCUMENTS

| | | | | |
|---|---|---|---|---|
| 4,255,488 | A * | 3/1981 | Gagliani | 428/398 |
| 4,990,384 | A * | 2/1991 | Jinbo | 428/36.1 |
| 6,294,049 | B1 * | 9/2001 | Tomioka et al. | 162/146 |
| 7,300,972 | B2 * | 11/2007 | Ozawa et al. | 524/538 |
| 2002/0040068 | A1 * | 4/2002 | Yamaguchi et al. | 521/50 |
| 2004/0229969 | A1 * | 11/2004 | Sato et al. | 521/90 |
| 2011/0114274 | A1 * | 5/2011 | Takano et al. | 162/157.2 |
| 2013/0157171 | A1 | 6/2013 | Kurokawa et al. | |

FOREIGN PATENT DOCUMENTS

| | | | |
|---|---|---|---|
| JP | 2002-012688 | | 1/2002 |
| JP | 2003-342892 | | 12/2003 |
| JP | 2004-323715 | | 11/2004 |
| WO | 2007/076343 | | 7/2007 |
| WO | WO 2010/007919 | A1 * | 1/2010 |
| WO | 2010/146223 | | 12/2010 |

* cited by examiner

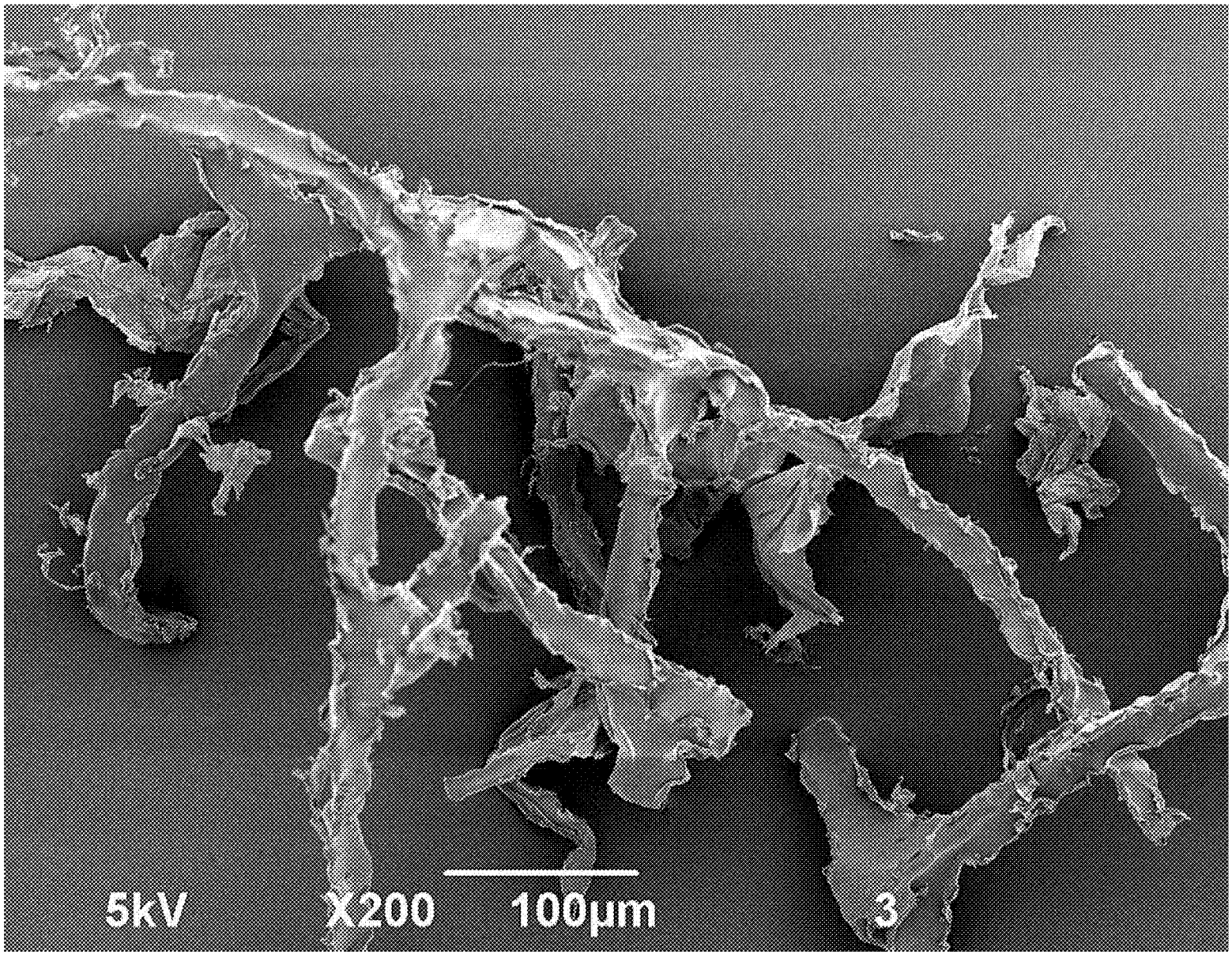
5kV
X200
100μm
3

POLYIMIDE SHORT FIBERS AND HEAT-RESISTANT PAPER COMPRISING SAME

RELATED/PRIORITY APPLICATION

This application is a National Phase filing regarding International Application No. PCT/JP2010/072678, filed on Dec. 16, 2010, which relies upon the following Japanese Patent application for priority: Japanese Patent Application No. 2009:285241, filed on Dec. 16, 2009.

TECHNICAL FIELD

The present invention relates to polyimide short fibers produced by beating a polyimide foam and a heat-resistant paper comprising the same.

BACKGROUND ART

Synthetic papers formed of fully aromatic polyamide (aramid) is known as a heat resistant paper having a good insulating property for use in a transformer and motor. Among them, a heat-resistant paper made from a mixture of an aramid pulp and aramid short fibers is well-known as a heat-resistant paper having a proper heat resistance and flexibility, and an excellent insulating property and dimension stability.

Polyimide is also well-known as a resin having an excellent heat resistance. In particular, aromatic polyimide is processed into various shapes and used since it has a very high heat resistance and excellent mechanical property. Non-woven fabrics and paper containing the short fibers of polyimide are also developed. For example, Patent document 1 discloses polyimide fibers obtained by spinning a thermoplastic polyimide resin and a polyimide paper containing the polyimide fibers. However, since fully aromatic polyimide has not occasionally a melting point depending on the structure thereof and may not be dissolved in a solvent, it may be hard to be spun. Therefore, it is proposed to produce short fibers using an acid solution composition containing polyamide that is a precursor of the aromatic polyimide as disclosed in Patent document 2. In general, in order to employ short fibers to produce non-woven fabrics and paper, it is important that the short fibers are interlocked each other and there preferably is a structure having a large number of branch. Therefore, the method is employed which comprises applying a shearing force on the fibers to form a pulp-like structure at spinning or after spinning.

Further, patent document 3 discloses a polyimide foam which is formed of polyimide having a glass transition temperature higher than 300° C., and has an expansion ratio of at least 20 times, and a method of producing the same. Patent document 4 discloses a foamed polyimide molded product manufactured by a method including crushing a polyimide foam, mixing the crushed polyimide foam with a heat resistant binder, introducing the mixture into a prescribed mold, pressing the mixture until a density thereof reaches to a certain value, and heating the pressed mixture.

PRIOR DOCUMENT

Patent document

Patent document 1: JP A-6-57529
Patent document 2: JP A-1-26718
Patent document 3: JP A-2002-12688
Patent document 4: JP A-2004-323715

SUMMARY OF THE INVENTION

Problems to be Solved by the Invention

It is an object of the present invention to provide polyimide short fibers having an extremely high heat resistance, suitable for non-woven fabrics and paper, and having many branches.

Means for Solving the Problems

In order to attain the object, the present inventors have studied and found that polyimide short fibers having many branches are produced by beating a prescribed polyimide foam, and completed the present invention.

Namely, the present invention provides polyimide short fibers produced by beating a polyimide foam. The polyimide foam comprises preferably a polyimide produced using an aromatic tetracarboxylic acid component, in particular 2, 3, 3',4'-biphenyltetracarboxylic acid. Preferably, the polyimide has a glass transition temperature of 300° C. or higher. Further, preferably, the polyimide foam has an expansion ratio of 20 times or more.

Further, the present invention provides a heat-resistant paper comprising the polyimide short fibers described above, and furthermore, provides a heat-resistant paper comprising a mixture of the polyimide short fibers and fully aromatic polyamide fibers.

Effect of the Invention

According to the present invention, there is provided polyimide short fibers having extremely high heat resistance, suitable for non-woven fabrics and paper, and having many branches.

BRIEF DESCRIPTION OF THE DRAWINGS

FIG. 1 is an electron microscope photograph showing polyimide short fibers.

DESCRIPTION OF EMBODIMENTS

A polyimide foam, which can be used in the present invention, is produced by the following steps, for example. At first, a precursor composition solution of the polyimide foam is prepared. Main components of tetracarboxylic acid component such as a half ester of 2, 3, 3',4'-biphenyltetracarboxylic acid dianhydride (occasionally abbreviated to a-BPDA hereinafter), and diamine component such as p-phenylene diamine (occasionally abbreviated to PPD hereinafter) and 4, 4'-diaminodiphenyl ether (occasionally abbreviated to ODA hereinafter) etc; a component for unifomly foaming such as diaminodisiloxane; and if necessary, an amine compound having at least 3 amino groups such as tetraaminobiphenyl, for example an aromatic triamine compound or aromatic tetraamine compound, are dissolved unifomly in an esterification solvent, for example, a lower primary alcohol such as methanol, ethanol, n-propanol and n-butanol, preferably, methanol or ethanol in such a composition ratio that a polyimide (imide resin having high molecular weight) is obtained. In this case, though a concentration of each component can reach to solubility limit of diamines etc., it is preferred that an amount of nonvolatile component ranges between 10% and 50%.

An imidation catalyst such as 1,2-dimethylimidazole, benzimidazol, isoquinoline and substituted pyridine may be added to this mixture.

Further, the other known additives such as an inorganic filler, and inorganic or organic pigment may be added.

Subsequently, the mixture is evaporated to dryness to form a powder. The evaporation is performed by evaporator experimentally, or by spray drier industrially. The evaporation temperature is preferably less than 100° C., and it is more preferable to be maintained at a temperature of 80° C. or lower. When drying is performed at a high temperature, expandability of the polyimide foam is extremely lowered. Drying is performed under a normal pressure, high pressure, or reduced pressure.

Then, a proper provisional molded body is prepared using thus obtained precursor composition powder of the polyimide foam. For example, the preparation of the proper provisional molded body is performed by a compression molding at a room temperature, a casting and drying of slurry, or a filling in a container that is inert to microwave. In this case, it is unnecessary to put the lid on the container. (Namely, it is unnecessary to perfectly harden the molded body.) If the provisional molded body is approximately uniform, uniformity at molding can be attained.

Subsequently, the provisional molded body is heated to expand and to perform an imidation. The heating is carried out preferably in two stages including a heating for foaming and another heating for heat fixing (converted to high molecular weight). The heating for foaming is preferably carried out by means of microwave heating with general microwave of 2.45 GHz that is demanded by Japanese domestic law (the Radio Law). It is desirable to select a power of microwave per powder weight as a guideline. For example, when the power of 100 g/1 kW is applied, foaming starts after 1 minute, and foaming converges after two or three minutes. At the time of foaming, it is desired to apply a compression force on the provisional molded body by arranging a masking shield, through which gas can pass, in order to mechanically dense the molded body, thus controlling an expansion ratio. In this state, since the polyimide has a low molecular weight, the obtained foam is very fragile.

The heating for heat-fixing (converted to high molecular weight) is carried out by blowing hot air and the like. In this case, it is desirable to gradually raise a temperature from about 200° C. (as a guideline, raising speed of about 100° C./10 minutes). Finally, the heating is performed at a temperature of Tg+40° C. for 5 to 60 minutes, preferably for about 10 minutes.

The tetracarboxylic acid component used in the present invention contains preferably 50% or higher of a-BPDA derivatives. Even if 3, 3',4, 4'-biphenyltetracarboxylic acid dianhydride (occasionally abbreviated to s-BPDA hereinafter) or pyromellitic acid dianhydride (occasionally abbreviated to PMDA hereinafter) is singly used as a tetracarboxylic acid component, foaming dose not occur. Therefore, it is necessary to use another acid component as auxiliary material against a-BPDA as a main component, that is, 0 to 50 mol % of aromatic tetracarboxylic acid dianhydride together with 100 mol % of the tetracarboxylic acid component in order to adjust Tg of polyimide to be produced, and expansion ratio (decreases as the usage increases). The aromatic tetracarboxylic acid dianhydride includes for example, s-BPDA, PMDA, 3,3',4,4'-benzophenonetetracarboxylic acid dianhydride (occasionally abbreviated to BTDA hereinafter), bis(3,4-dicarboxyphenyl)ether dianhydride, 2,3,6,7-naphthalene tetracarboxylic acid dianhydride, 1,2,5,6-naphthalene tetracarboxylic acid dianhydride, 1,2,4,5-naphthalene tetracarboxylic acid dianhydride, 1,4,5,8-naphthalene tetracarboxylic acid dianhydride, 2,2-bis(2,5-dicarboxyphenyl)propane dianhydride, 1,1-(2,3-dicarboxyphenyl)ethane dianhydride, 1,1-bis(3,4-dicarboxyphenyl)sulfonic acid dianhydride, 1,3-bis(3,4-dicarboxyphenyl)-1,1,3,3-tetramethyldisiloxane dianhydride, and the like. All acid components generally used can be employed as long as Tg of the polyimide does not significantly change.

The diamine component may contain preferably two-nuclei diamine as a main component, whereby the glass transition temperature (Tg) of the polyimide foam easily attains 300° C. or higher. Though multi-substituted amine component is unnecessarily contained in the polyimide foam, it is preferably partly contained in order to prevent shrinkage of the foam in a high temperature and increase strength of the foam (hard to be broken). It is necessary that an amount of diaminodisiloxane ranges between 0.1 mol % and 10 mol %, preferably 0.2 mol % and 5 mol % in order to uniformly expand since the diaminodisiloxane acts like a surfactant. When the amount of the diaminodisiloxane is small, uniform foaming is not performed, whereas when the amount of the diaminodisiloxane is large, Tg of the polyimide is lowered and the thermal stability thereof deteriorates. Even if diaminopolysiloxane is used, uniformity of foaming may be attained. However, in this case, since a sea-island structure is contained in the foam, the foam is easily decomposed to lower undesirably a heat resistance of the foam.

Properties of the polyimide short fibers of the present invention, such as fiber diameter, branched structure and the like, can be controlled by adjusting an expansion ratio of the polyimide foam. The expansion ratio of the polyimide foam ranges preferably between 20 times and 300 times, more preferably between 50 times and 250 times, and particularly preferably between 100 times and 200 times. When the expansion ratio is too large, a fiber diameter becomes thin, and it is difficult to produce a paper having a high strength. On the other hand, when the expansion ratio is too small, it is difficult to beat the foam into fibrous form. Further, as a foam cell becomes smaller, the foam becomes undesirably the structure having more branches.

The expansion ratio can be controlled by adjusting an amount of gas produced by heating, usage of a foaming agent, and the like. Further, the size of the foam cell can be controlled by adjusting the surface tension of the polyimide with a foam stabilizer.

The polyimide short fibers of the present invention are obtained by beating thus obtained polyimide foam. Beating may be performed by means of a beating machine. Alternatively, beating may be performed by grinding the polyimide foam with the likes of a grinder for a molded mass of plastics, and homogenizing the ground polyimide foam with a homogenizer in a dispersion such as water. Since the polyimide foam is formed of fibrous material having a branched structure, it is sufficient that the length of the fibers can be controlled. It is unnecessary to introducing a branched structure into the polyimide foam by shear force.

Since the polyimide short fibers of the present invention have a branched structure and are easily entangled with each other, it is possible to produce non-woven fabrics and paper by known sheet making methods without adding pulp-like components. Further, when non-woven fabrics and paper, which contains mainly the other heat resistant fibers such as aramid fibers or polyester fibers, are produced, it is possible to improve heat resistance and size stability by adding the polyimide short fibers of the present invention.

In the heat resistant paper of the present invention, when the polyimide short fibers of the present invention is used together with another heat resistant fibers, it is preferred to use 20 weight % or over of the polyimide short fibers of the present invention. When usage of the polyimide short fibers is small, it may be occasionally insufficient to improve the heat resistance. It is preferred to use short fibers such as a pulp, cut fibers, and the like as the other heat resistant fibers. Long fibers such as staples, filaments and the like are undesirable since papers are hardly to be produced uniformly by using such long fibers. The other heat resistant fibers include, for example, fully aromatic polyamide Kevlar, registered trade mark, dry pulp; manufactured by DU PONT-TOREY CO., LTD.

The sheet-making method is not limited, and for example, the papers can be produced by wet process in the following steps. At first, after the polyimide foam is grinded by a grinder for molded mass of plastics, desired polyimide short fibers are prepared in a dispersion medium such as water by using a homogenizer. Then, if necessary, the other heat resistant fibers or auxiliaries is added to the dispersion to form a slurry, and the slurry is subjected to a sheet-making process by a sheet-making machine or the like to obtain a heat resistant paper.

The apparatus for producing the heat resistant paper includes, for example, a cylinder wet-type former, short-wire wet-type former, short-wire inclined wet-type former, fourdrinier inclined wet-type former, and the like.

Where the polyimide short fibers of the present invention is singly used, a heat resistant paper having higher strength can be obtained by hot-pressing the heat resistant paper produced by a sheet-making process. In particular, it is desirable to perform hot-pressing at a pressure of 0.1 to 2000 MPa and a temperature of 350 to 600° C. in order to improve a strength of the heat resistant paper. The apparatus for hot-pressing includes a high pressure hot press, calender roll, double belt press and the like.

EXAMPLE

There will be described Examples of the present invention. In each example, various physical properties of the heat resistant papers are measured by the following test methods.

(1) Basis Weight (g/m$^2$)

A heat resistant paper is cut into a rectangle. The width and length of the cut paper are measured by a slide gauge measurable until 0.01 mm and the weight of the cut paper is measured by a weighting machine measurable until 0.1 mg in weight (g) per unit area ($m_2$)

(2) Reduction Rate of Weight (%)

A heat resistant paper is cut into a rectangle having 3 cm of width and 5 cm of length. The initial weight and the weight after heat treatment, of the cut paper are measured by a weighting machine measurable until 0.1 mg in weight. The reduction rate is represented by percentage of change in weight from the initial weight.

(3) Rate of Change in Dimension (%)

A heat resistant paper is cut into a rectangle having 3 cm of width and 5 cm of length. The initial length and the length after heat treatment, of the cut paper are measured by a slide gauge measurable until 0.01 mm. The rate of change in dimension is represented by percentage of change in length from the initial length.

(4) Tensile Strength at Break

Measured according to JIS P 8113.

(5) Gas Permeability Rate

Measured according to JIS P 8117 using Gurley test machine.

(6) Falling Rate of Tensile Strength

Determined according to the following equation.

$$\text{Falling rate of tensile strength (\%)}=[(\text{tensile strength after test})-(\text{initial tensile strength})]/\text{initial tensile strength}]\times 100 \quad \text{[Expression 1]}$$

(7) Exposure to Ultraviolet Rays

Exposed to ultraviolet rays at a temperature of 70° C. or lower for 120 hours using Solar box 1500 produced by CO.FO.ME.GRA Co. Ltd.

(8) Insulating Resistance

A surface resistance and a volume resistance after application of 100 V for 1 minute are measured in an atmosphere of 45% at 23° C. by means of HIGH RESISTANCE METER produced by HP Co. Ltd.

Abbreviated words represent the following compounds hereinafter.

a-BPDA: 2,3,3', 4'-biphenyltetracarboxylic acid dianhydride

BTDA: 3,3', 4,4'-benzophenonetetracarboxylic acid dianhydride

PPD: p-phenylene diamine

ODA: 4,4'-diaminodiphenyl ether

DADSi: 1,3-bis(3-aminopropyl) tetramethyldisiloxane

DMZ: 1,2-dimethyl imidazole

Example 1

(Production of Polyimide Foam)

47.1 g (160 mmol) of a-BPDA, 12.9 g (40 mmol) of BTDA, 75 g of MeOH, and 2.5 g of DMZ as a catalyst were charged in an egg plant Flask of a 500-mL content, followed by heating and stirring for 60 minutes under reflux in a oil bath at a temperature of 90° C. to obtain a homogeneous reaction solution. Then, the reaction solution was cooled to 30° C., followed by adding 21.4 g (198 mmol) of PPD, 0.5 g (2 mmol) of DADSi, and 77.1 g of MeOH to form a homogeneous solution. The solution was concentrated by an evaporator and dried by a vacuum dryer at 40° C. to obtain a solid matter. Further, the solid matter was grinded in a mortar to obtained a raw powder.

The raw powder was compression molded by a compression molding press (S-37.5 produced by SHINTO Metal Industries Co., Ltd.) with a spacer of 5 mm at a room temperature. Thus obtained molded product was subjected to microwave heating for 5 minutes by a microwave oven (MOH: produced by Micro DENSHI Co., Ltd.) with 3000 W to obtain a foamed product. After the foamed product was heated for 5 minutes in a heating oven set to 180° C., the temperature was raised to 360° C. for 36 minutes and maintained at that temperature for 30 minutes. The obtained polyimide foam has an expansion ratio of 150 times, an apparent density of 9.0 kg/m$^3$, and a glass transition temperature (Tg) of 373° C.

(Production of Polyimide Short Fibers and Sheet Making)

The polyimide foam was grinded to a size of about 1 mm by Willey grinder and 3.5 g of the grinded foam was charged in a 3-L beaker containing 1 L of water and dispersed by means of a homogenizer (ULTRA-DISPERSER MODEL LK-42 produced by Yamato Scientific Co., Ltd.) for 1 minute to obtain a slurry containing polyimide short fibers. While the slurry was agitated, it was charged in Buchner funnel of 150 mm diameter (fitted up with a filter paper of 150 mm diameter; Toyo Roshi paper No. 5A) provided with a suction bottle of 3 L content, and water was removed from the slurry by aspirating with an aspirator to form a wet paper. This wet paper was dried at a temperature of 100° C. for 1 hour to obtain a heat resistant paper made of polyimide short fibers. Furthermore, the heat resistant paper was hot-pressed at a temperature of 370° C., pressure of 5 MPa for 10 seconds by a pressing machine (Compression press YSR-10 produced by SHINTO Metal Industries Co., Ltd.). Properties of thus obtained heat resistant paper are shown in Table 1. Properties of the heat resistant paper after it was exposed to atmosphere of 350° C. for 1 hour are shown in Table 2.

TABLE 1

| | Basis weight ($g/m^2$) | Gas permeability Rate (second) | Tensile strength at break (g/15 mm) |
|---|---|---|---|
| Example 1 | 100 | 1.1 | 533 |
| Example 2 | 135 | 4.5 | 117 |
| Example 3 | 132 | 5.0 | 213 |
| Comparative Example 1 | 137 | 7.9 | 213 |

TABLE 2

| | Reduction rate of weight (%) | Rate of change in dimension (%) | Tensile strength at break (g/15 mm) |
|---|---|---|---|
| Example 1 | 0.5 | −0.05 | 525 |
| Example 2 | 1.8 | −0.5 | 413 |
| Example 3 | 2.1 | −0.8 | 713 |
| Comparative Example 1 | 3.0 | 1.6 | 708 |

Example 2

The heat resistant paper was produced in the same manner as in Example 1 except that about 1.4 g of a ground product of a polyimide foam and 2.1 g of fully aromatic polyamide fibers (Kevlar, registered trade mark, dry pulp; produced by DU PONT-TOREY CO., LTD.) were used. Properties of the obtained heat resistant paper are shown in Table 1. Properties of the heat resistant paper after it was exposed to atmosphere of 350° C. for 1 hour are shown in Table 2.

Example 3

The heat resistant paper was produced in the same manner as in Example 1 except that about 0.7 g of a ground product of a polyimide foam and 2.8 g of fully aromatic polyamide fibers (Kevlar, registered trade mark, dry pulp; produced by DU PONT-TOREY CO., LTD.) were used. Properties of the obtained heat resistant paper are shown in Table 1. Properties of the heat resistant paper after it was exposed to atmosphere of 350° C. for 1 hour are shown in Table 2.

Comparative Example 1

The heat resistant paper was produced in the same manner as in Example 1 except that 3.5 g of fully aromatic polyamide fibers (Kevlar, registered trade mark, dry pulp; produced by DU PONT-TOREY CO., LTD.) was used without using a ground product of a polyimide foam. Properties of the obtained heat resistant paper are shown in Table 1. Properties of the heat resistant paper after it was exposed to atmosphere of 350° C. for 1 hour are shown in Table 2.

Example 4

8 kg of a ground product of a polyimide foam and 2 kg of fully aromatic polyamide fibers (Twaron, registered trade mark, pulp, produced by Teijin Ltd.) were dispersed in 190 L of water, and thus formed dispersion was subjected to a continuous sheet making machine and dried at a temperature of 100° C. to form 100 m of a serial heat resistant paper having a width of 500 mm and a basis weight of 100 $g/m^2$. Further, the heat resistant paper is cut into a size of 210 mm×300 mm and the cut paper was passed through a calender roll machine (produced by YURI ROLL MACHINE CO., LTD.) set to 360° C. under a pressure of 100 kN/m and at a passing speed of 2 min./m. Properties of the obtained heat resistant paper, properties of that after it was exposed to ultraviolet rays, and properties of that after it was subjected to a heat resistant test at a temperature of 350° C. for 30 hours are shown in Table 3 and Table 4.

TABLE 3

| | Before calender rolling | | After calender rolling | |
|---|---|---|---|---|
| | Thickness (mm) | Tensile strength at break (Kg/15 mm) | Thickness (mm) | Tensile strength at break (Kg/15 mm) |
| Example 4 | 0.55 | 0.6 | 0.15 | 1.5 |
| Example 5 | 0.53 | 1.1 | 0.14 | 2.0 |
| Example 6 | 0.34 | 0.6 | 0.10 | 0.8 |
| Comparative Example 2 | 0.23 | 0.6 | 0.10 | 1.2 |

TABLE 4

| | | | After exposure to ultraviolet rays | After 30 hours, 350° C. | |
|---|---|---|---|---|---|
| | Insulating resistance (Surface resistance) (Ω) | Insulating resistance (Volume resistance) (Ω · cm) | Falling rate of tensile strength (%) | Reduction rate of weight (%) | Falling rate of tensile strength (%) |
| Example 4 | $10^{15}$ | $10^{15}$ | 7 | 4.0 | 13.3 |
| Example 5 | $10^{15}$ | $10^{15}$ | — | 5.0 | 20.0 |
| Example 6 | $10^{15}$ | $10^{15}$ | — | 6.5 | — |
| Comparative Example 2 | $10^{15}$ | $10^{15}$ | 8 | 14.4 | 48.8 |

Example 5

The heat resistant paper was produced in the same manner as in Example 4 except that about 7 kg of a ground product of a polyimide foam and 3 kg of fully aromatic polyamide fibers (Twaron, registered trade mark, pulp, produced by Teijin Ltd.) were used.

Properties of the obtained heat resistant paper, properties of that after it was exposed to ultraviolet rays, and properties of that after it was subjected to a heat resistant test at a temperature of 350° C. for 30 hours are shown in Table 3 and Table 4.

Example 6

The heat resistant paper was produced in the same manner as in Example 4 except that about 7 kg of a ground product of a polyimide foam and 3 kg of fully aromatic polyamide fibers (Twaron, registered trade mark, pulp, produced by Teijin Ltd.) were used, and sheet making is performed such that a basis weight of 60 g/m$^2$ was obtained. Properties of the obtained heat resistant paper, properties of that after it was exposed to ultraviolet rays, and properties of that after it was subjected to a heat resistant test at a temperature of 350° C. for 30 hours are shown in Table 3 and Table 4.

Comparative Example 2

The heat resistant paper was produced in the same manner as in Example 6 except that 10 kg of fully aromatic polyamide fibers (Twaron, registered trade mark, pulp, produced by Teijin Ltd.) was used. Properties of the obtained heat resistant paper, properties of that after it was exposed to ultraviolet rays, and properties of that after it was subjected to a heat resistant test at a temperature of 350° C. for 30 hours are shown in Table 3 and Table 4.

What is claimed is:

1. Polyimide short fibers having a branched structure, the fibers produced by beating a polyimide foam, the length of the fibers being controlled during beating.

2. The polyimide short fibers according to claim 1, characterized in that the polyimide foam comprises polyimide produced using an aromatic tetracarboxylic acid component.

3. The polyimide short fibers according to claim 2, characterized in that the aromatic tetracarboxylic acid is 2,3,3,4'-biphenyltetracarboxylic acid.

4. The polyimide short fibers according to claim 1, characterized in that the polyimide foam has an expansion ratio and a glass transition temperature, the expansion ratio being 20 times or more and the glass transition temperature (Tg) being 300° C. or higher.

5. The polyimide short fibers according to claim 2, characterized in that the polyimide foam has an expansion ratio and a glass transition temperature, the expansion ratio being 20 times or more, and the glass transition temperature (Tg) being 300° C. or higher.

6. The polyimide short fibers according to claim 3, characterized in that the polyimide foam has an expansion ratio and a glass transition temperature, the expansion ratio being 20 times or more, and the glass transition temperature (Tg) being 300° C. or higher.

7. A heat-resistant paper comprising the polyimide short fibers according to claim 1.

8. A heat-resistant paper comprising the polyimide short fibers according to claim 2.

9. A heat-resistant paper comprising the polyimide short fibers according to claim 3.

10. A heat-resistant paper comprising the polyimide short fibers according to claim 4.

11. A heat-resistant paper comprising the polyimide short fibers according to claim 5.

12. A heat-resistant paper comprising the polyimide short fibers according to claim 6.

13. A heat-resistant paper comprising a mixture of the polyimide short fibers according to claim 1 and fully aromatic polyamide fibers.

14. A heat-resistant paper comprising a mixture of the polyimide short fibers according to claim 2 and fully aromatic polyamide fibers.

15. A heat-resistant paper comprising a mixture of the polyimide short fibers according to claim 3 and fully aromatic polyamide fibers.

16. A heat-resistant paper comprising a mixture of the polyimide short fibers according to claim 4 and fully aromatic polyamide fibers.

17. A heat-resistant paper comprising a mixture of the polyimide short fibers according to claim 5 and fully aromatic polyamide fibers.

18. A heat-resistant paper comprising a mixture of the polyimide short fibers according to claim 6 and fully aromatic polyamide fibers.

* * * * *